US006069616A

United States Patent [19]

Rozum, Jr.

[11] Patent Number: 6,069,616

[45] Date of Patent: May 30, 2000

[54] POSTAL SECURITY DEVICE WITH COMPUTER KEYBOARD INTERFACE

[76] Inventor: Andrew L. Rozum, Jr., 17 Ave. E. Ext., Beacon Falls, New Haven County, Conn. 06403

[21] Appl. No.: 09/000,810

[22] Filed: Dec. 30, 1997

[51] Int. Cl.[7] ..... G09G 5/00

[52] U.S. Cl. ..... 345/168; 380/21; 705/410

[58] Field of Search ..... 345/168, 156, 345/169, 173, 1, 2, 3; 705/410, 408, 411; 380/21, 227; 400/103

[56] References Cited

U.S. PATENT DOCUMENTS

| | | | |
|---|---|---|---|
| 5,111,030 | 5/1992 | Brasington et al. | 235/375 |
| 5,396,267 | 3/1995 | Bouton | 345/168 |
| 5,590,198 | 12/1996 | Lee et al. | 380/21 |
| 5,600,562 | 2/1997 | Guenther | 364/464.11 |
| 5,731,980 | 3/1998 | Dolan et al. | 705/410 |
| 5,812,666 | 9/1998 | Baker et al. | 380/277 |
| 5,812,991 | 9/1998 | Kara | 705/410 |
| 5,890,818 | 4/1999 | Sansone | 400/103 |
| 5,978,781 | 11/1999 | Sansone | 705/408 |

OTHER PUBLICATIONS

United States Postal Service, Information Based Indicia Program Postal Security Device Specification, Jun. 13, 1996.

*Primary Examiner*—Xiao Wu

*Attorney, Agent, or Firm*—Fitzpatrick, Cella, Harper & Scinto

[57] ABSTRACT

An system for interfacing a PSD to a computer is provided. The system includes a splitter that receives signals from a keyboard associated with the computer, and distributes those signals to both the computer and a keyboard monitoring circuit. The keyboard monitoring circuit converts the keyboard signals into keystroke information which is provided to the security controller in the PSD. Portions of the interface circuitry may be combined into the same housing as the PSD.

11 Claims, 4 Drawing Sheets

POSTAL SECURITY DEVICE WITH COMPUTER KEYBOARD INTERFACE

BACKGROUND OF THE INVENTION

The present invention relates to a postal security device (PSD) for use in a postage meter. More specifically, it relates to interfacing a PSD with a computer using only the keyboard port of the computer and one additional computer port.

The United States Postal Service has proposed an Information Based Indicia Program (IBIP) to replace the indicia (postmarks) printed by traditional postage meters. IBIP will use a two-dimensional symbol printed on the envelope to provide evidence that postage was paid, as well as providing additional information fields. This information is encoded into the symbol together with security information. The two-dimensional symbols can be thought of as an advanced version of the bar codes that are commonly used to identify products in supermarkets.

In contrast to traditional postage meters, in which all the indicia with the same postage value printed on a given day are identical, the indicia printed on each piece of mail using an IBIP symbol will be different. This will create a unique and traceable identity for each piece of mail.

A PSD is a security device that is used in conjunction with a host system to create the IBIP indicia. The PSD is implemented in hardware and provides a number of security functions, including cryptographic digital signature generation and verification. The PSD also maintains the descending register, which tracks the amount of postage available for postmark creation, and the ascending register, which tracks the total postage value used by a given PSD. These registers perform the same functions as the ascending and descending registers of traditional postage meters.

Postage may be loaded into the PSD, either at a post office or by a remote communications link. When this occurs, the descending register is updated to keep track of the amount of postage available for printing indicia. As the indicia are printed, the descending register is decremented to reflect the amount of postage that remains.

It is envisioned that PSDs will be used in a dedicated, stand-alone postage meter. It is also envisioned that PSDs will be used in conjunction with ordinary computers, in which case the indicia will be printed by ordinary computer printers. The security functions provided by the PSD will prevent the fraudulent printing of postage indicia.

The Postal Service's PSD specifications require the use of a data port connector and an authentication port connector that are physically distinct from each other. While Applicants are unaware of any commercially available PSD, a block diagram of a basic PSD that meets this requirement in a computer based environment can be readily envisioned.

FIG. 1 shows an example of such a PSD 11, connected to a computer 21. The PSD 11 contains a security controller 13, which provides the security functions of the PSD 11, including maintaining the ascending and descending registers, and generating digital signatures. The security controller 13 communicates with the computer via the data port 14 and the authentication port 15 which are, as required by the PSD specification, physically distinct.

The computer 21 includes a parallel port 22, a serial port 23, and a keyboard port 24. The parallel port 22 is connected to the data port 14 of the PSD 11 using an appropriate cable or connector. Similarly, the serial port 23 is connected to the authentication port 15 of the PSD 11 using an appropriate cable or connector. The computer 21 could be any suitable type of computer including, for example, IBM PC and Apple Macintosh computers (and compatibles). The keyboard 25 is connected to the computer 21 by plugging the end 26*a* of the keyboard cable 26 into the keyboard port 24 of the computer 21, to provide keyboard signals to the computer in a conventional manner.

The computer communicates with the data port 14 of the PSD 11 via the parallel port 22. Similarly, the computer 21 communicates with the authentication port 15 of the PSD 11 via the serial port 23. Both the PSD control program and the software in the computer 21 are configured to communicate using the appropriate port in a conventional manner. While FIG. 1 shows the use of one parallel port 22 and one serial port 23, any combination of ports may be used (e.g., two parallel ports), as long as the computer ports 22 and 23 and the PSD ports 14 and 15 are compatible.

While this configuration provides a workable PSD, one serious drawback is that it uses two ports of the computer 21. With many computer setups, however, the computer 21 will already be hooked up to various other devices using the ports 22 and 23, and the two required computer ports will not be available. In some cases it may be impossible to add addition ports, such as when all the expansion slots of the computer 21 are occupied. This is particularly likely to be a problem with laptop computers, which usually have limited expansion capabilities.

Even in those computer setups where additional ports can be added, it may be undesirable to add ports for a number of reasons. For example, many users are reluctant to open up their computers to install additional hardware. In addition, the set up required to add a port may be difficult, time consuming, or beyond the capabilities of the computer user.

SUMMARY OF THE INVENTION

Accordingly, it is an object of the present invention to provide a computer compatible PSD that meets all postal service specifications yet reduces the number of ports needed on the computer to interface with the PSD.

Another object of the present invention is to enable a PSD to be interfaced with a computer when only one parallel or serial port on the computer is available.

In accordance with an aspect of the present invention, a system for interfacing a PSD with a computer is provided. The system includes a keyboard monitoring circuit, and a splitter for receiving keyboard signals and providing them to a keyboard port of the computer and the keyboard monitoring circuit. Based on the keyboard signals, the keyboard monitoring circuit determines which keys were pressed, and provides this information to the authentication port of the PSD.

In accordance with another aspect of the present invention, a PSD with a computer interface is provided. The apparatus includes a PSD which includes (1) a security controller for performing security functions, (2) an authentication port, and (3) a keyboard monitoring circuit. The keyboard monitoring circuit has an input connected to the authentication port and an output connected to the security controller. The apparatus also includes a splitter for (1) receiving keyboard signals from a keyboard associated with the computer and (2) providing the keyboard signals to a keyboard port of the computer and the authentication port of the PSD. The keyboard monitoring circuit determines keystroke information based on the keyboard signals received from the authentication port, and provides the keystroke information to the security controller.

In accordance with another aspect of the present invention, a PSD with a computer interface is provided. The apparatus includes a PSD which includes (1) a security controller for performing security functions and (2) an authentication port connected to an input of the security controller. The apparatus also includes a keyboard monitoring circuit with an output connected to the authentication port, and a splitter for (1) receiving keyboard signals from a keyboard associated with the computer and (2) providing the keyboard signals to a keyboard port of the computer and the keyboard monitoring circuit. The keyboard monitoring circuit determines keystroke information based on the keyboard signals received from the splitter, and provides the keystroke information to the authentication port of the PSD.

In accordance with another aspect of the present invention, a PSD that is capable of interfacing with a computer and a computer keyboard is provided. This PSD includes a security controller for performing security functions, an authentication port, and a keyboard return port. The PSD also includes a keyboard monitoring circuit having (1) an output provided to the security controller and (2) an input. A splitter receives keyboard signals from the computer keyboard via the authentication port, and provides the keyboard signals to a keyboard port of the computer via the keyboard return port. The keyboard monitoring circuit also provides the keyboard signals to the input of the keyboard monitoring circuit. The keyboard monitoring circuit determines keystroke information based on the keyboard signals received from the splitter, and provides the keystroke information to the security controller.

BRIEF DESCRIPTION OF THE DRAWINGS

The above, and other objects, features, and advantages of the present invention will be apparent in the following detailed description of illustrative embodiments thereof, which is to be read in connection with the accompanying drawings, wherein.

DETAILED DESCRIPTION OF THE PREFERRED EMBODIMENTS

Figure 1:
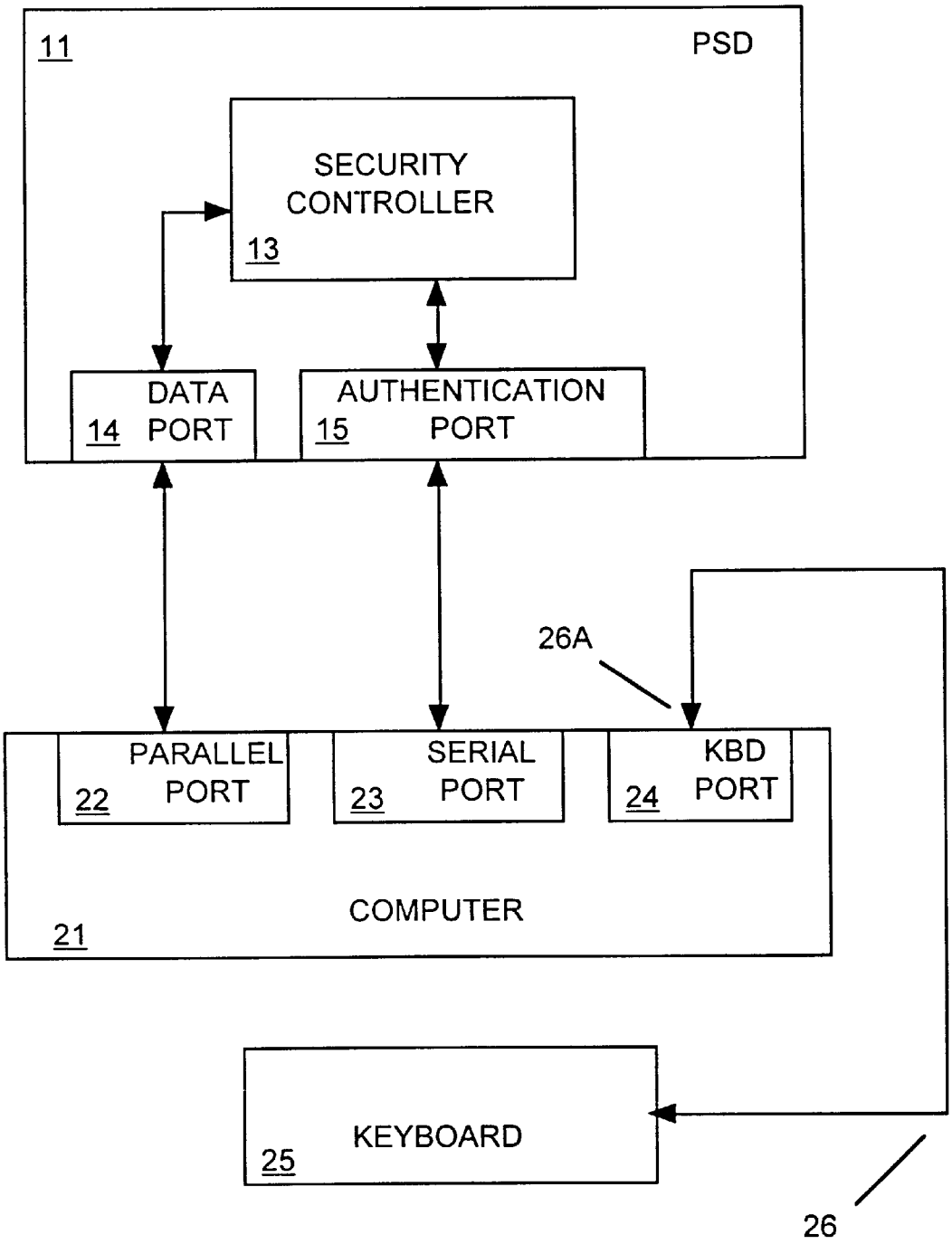
FIG. 1 is a block diagram of a PSD connected to a computer that does not employ the present invention.
Figure 2:
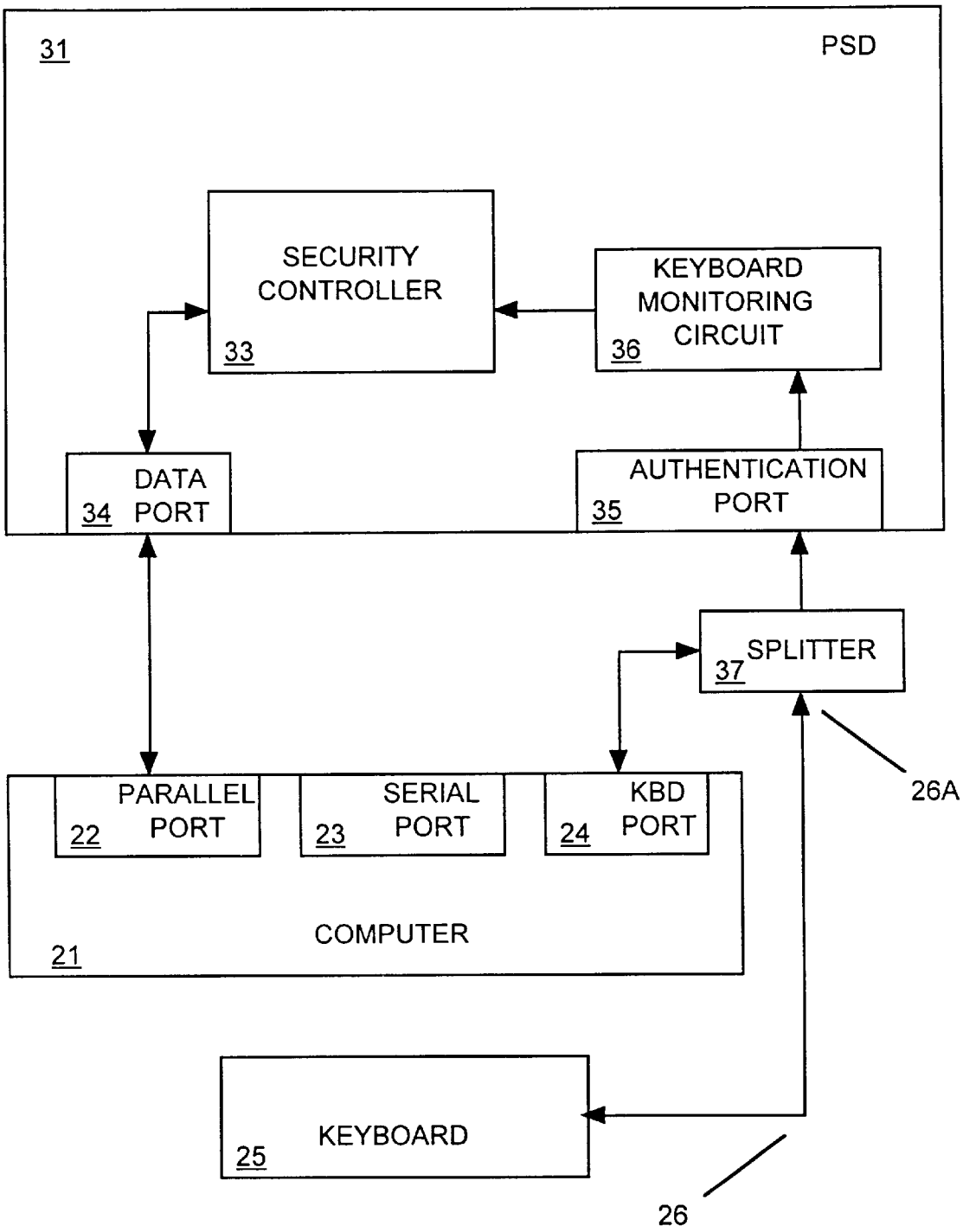
FIG. 2 is a block diagram of a PSD connected to a computer in accordance with the present invention.

FIG. 2 is a block diagram of a PSD 31 hooked up to a computer 21 in accordance with the present invention. Reference numbers 21 through 26 are the same as the corresponding reference numbers in FIG. 1. The connections between the computer 21 and the security controller 33 through the parallel port 22 and the data port 34 are also the same as the corresponding connections shown in FIG. 1.

The connections to the authentication port, however, are different. Instead of plugging the end 26*a* of the keyboard cable 26 directly into the keyboard port 24 of the computer 21, the cable 26 goes to a splitter 37. The splitter 37 distributes the signals coming from the keyboard 25 to two destinations: the keyboard port 24 of the computer 21 and the authentication port 35 of the PSD 31. Because the signals from the keyboard still reach the computer 21 via the keyboard port 24, the splitter 37 does not affect the arrival of keyboard signals from the keyboard 25. The computer 21 will therefore operate normally, just as if the keyboard 25 were connected directly to the keyboard port 24.

In addition to providing th e keyboard's signals to the keyboard port 24, the splitter 37 also provides these signals to the PSD 31. The signals are used by the security controller 33 when it requires an input from the authentication port.

More specifically, the keyboard signals arriving from the splitter 37 are provided to the authentication port 35 of the PSD 31. These signals are provided to the keyboard monitoring circuit (KMC) 36 in the PSD 31. Based on these signals, the KMC determines which keys have been depressed on the keyboard 25 and generates corresponding keystroke information. The KMC may be implemented using a microcontroller, in a manner well known to those skilled in the art. Of course, other ways to perform the keyboard monitoring may be used, including, for example, using hard-wired control logic in the KMC. The KMC 36 and the security controller 33 may both be implemented within a single component, such as an integrated circuit, using either hardware or software. This arrangement can be implemented in ways well known to those skilled in the art, including, for example, time-sharing, multitasking, polling, and interrupts.

The KMC makes the keystroke information available to the security controller 33. When the security controller wishes to perform an authentication function, it reads the keystroke information from the KMC. When the security controller 33 is not performing an authentication function, it ignores or discards the keystroke information arriving from the KMC 36.

To prevent the KMC 36 from interfering with the normal response of the computer 21 to keystrokes entered on the keyboard 25, it is preferable if only the keyboard port 24 of the computer 21 is able to acknowledge a communication to the keyboard 25. With this configuration, the KMC never sends any data back to the keyboard. This is indicated by the single arrow heads in the path between the KMC 36 and the splitter 37, in contrast to the double arrow heads on the lines connecting the keyboard 25 to the splitter 37, and the splitter 37 to the keyboard port 24.

In systems where the keyboard-to-computer link uses a bidirectional data bus, this arrangement can be implemented a by using a receive-only device at the input to the KMC 36. Alternatively, in systems where the keyboard-to-computer link uses dedicated signal lines (wires) for sending information back to the keyboard 25, those wires should never be driven by the KMC 36.

By splitting the keyboard cable in this manner, normal control of the computer via the keyboard can be accomplished, while still providing data to the PSD 31 via the authentication port 35. When a PSD is reading the data from the authentication port 35, the computer 21 may be programmed to ignore or discard the data arriving at the keyboard port 24 (which will be an identical copy of the data arriving at the authentication port 35).

Using the keyboard port for this purpose is advantageous because nearly all computers include a connector for interfacing with a keyboard. By tapping into the keyboard-to-computer link to provide communications with the authentication port, adding a dedicated port to the computer to perform authentication becomes unnecessary. This is indicated in FIG. 2 by the fact that no connections are made to the serial port 23, which remains free for other uses. Notably, this benefit is provided while still meeting the PSD specification that requires physically distinct data and authentication ports.

While FIG. 2 indicates that the KMC 36 is located inside the PSD 31 and the splitter 37 is located outside the PSD 31, alternative embodiments can be easily implemented, with various portions of the interface circuitry being provided within the same housing as the security controller 33.

Figure 3:
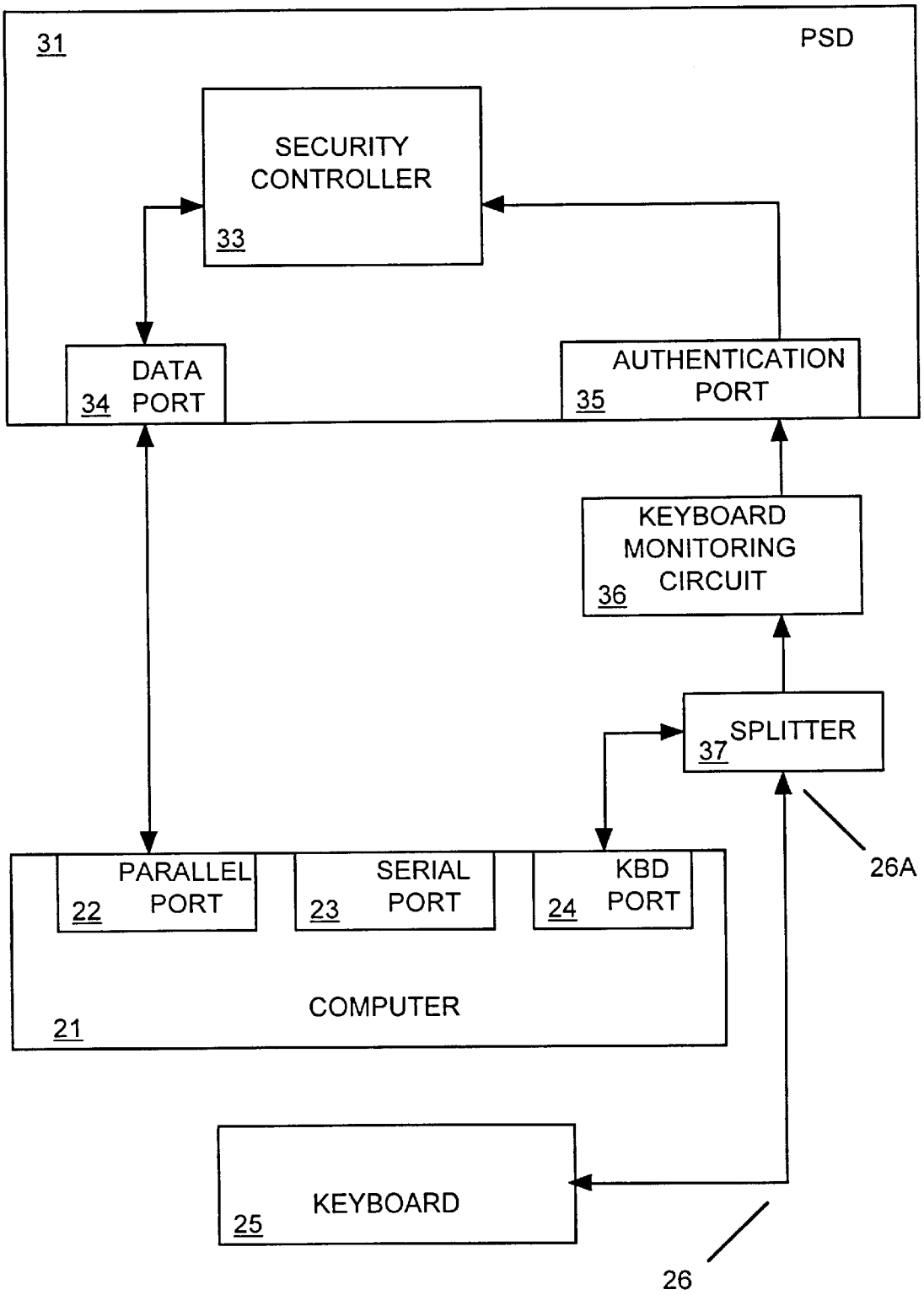
FIG. 3 is a block diagram of a PSD connected to a computer in accordance with another embodiment of the present invention.

For example, FIG. 3 shows an alternative embodiment in which the KMC 36 is provided outside the boundary of the PSD 31. In this embodiment, the KMC 36 and the splitter 37 shown in FIG. 3 may be provided as a stand-alone adapter to adapt an existing PSD to a computer. In this case, it may be necessary to incorporate a data format converter into the KMC 36 to match the authentication port interface specifications of the existing PSD. For example, a serial-to-parallel conversion or a voltage level conversion may be required. The necessary conversions may be implemented in a conventional manner.

Figure 4:
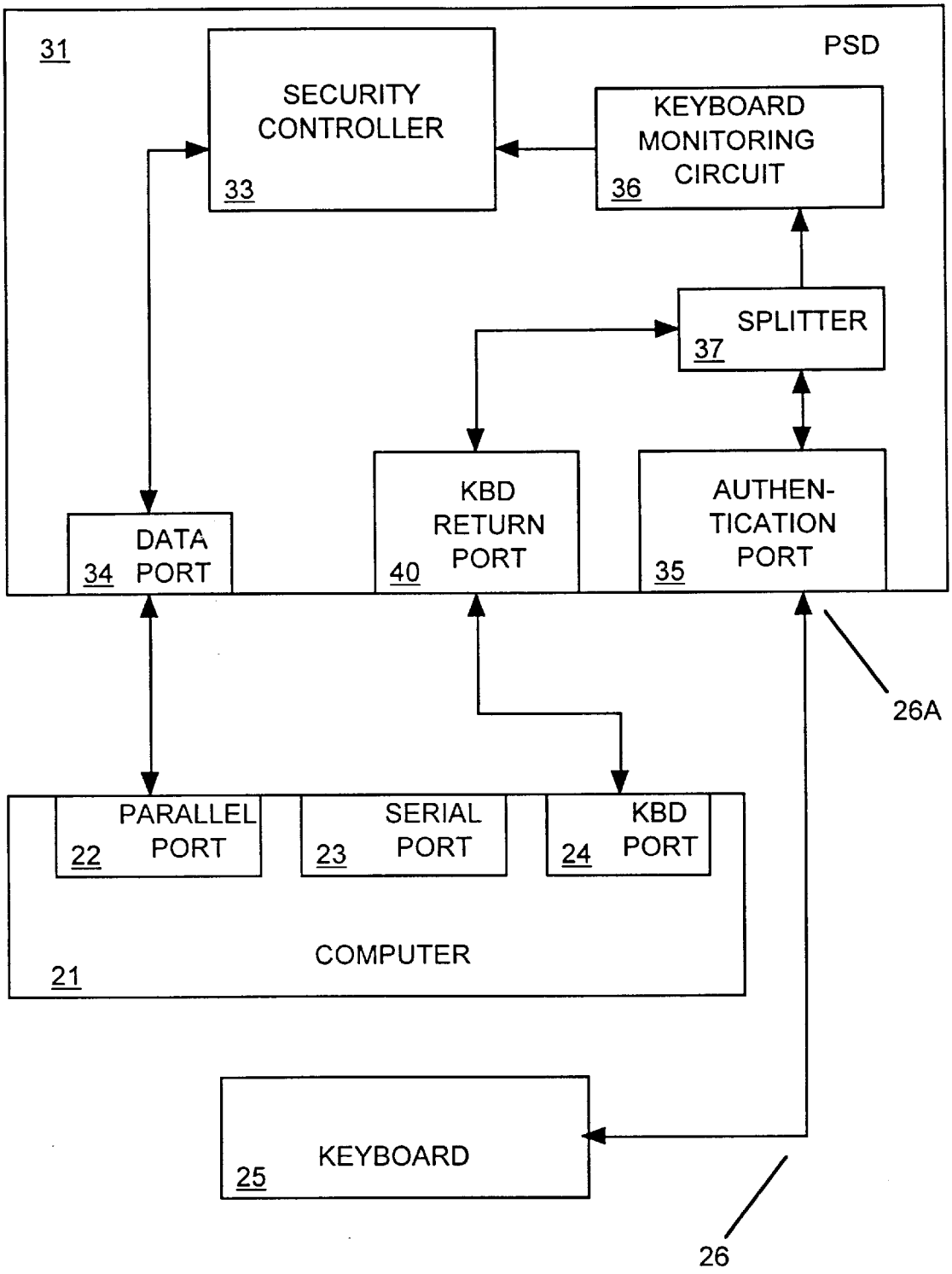
FIG. 4 is a block diagram of a PSD connected to a computer in accordance with yet another embodiment of the present invention.

FIG. 4 shows yet another alternative embodiment in which the splitter 37 is provided inside the boundary of the PSD 31. In this embodiment, a keyboard return port 40 is added to the PSD 31 to allow the signal from the splitter 37 to reach the keyboard port 24 of the computer 21.

While the present invention has been described above with reference to the specific embodiments, it is to be understood that the invention is not limited to those precise embodiments, and that various changes and modifications can be effected therein without departing from the scope or spirit of the present invention.

What is claimed is:

1. A system for interfacing a PSD with a computer, the system comprising:

a keyboard monitoring circuit;

a splitter for receiving keyboard signals from a keyboard associated with the computer and providing the keyboard signals to a keyboard port of the computer and the keyboard monitoring circuit, wherein the keyboard monitoring circuit determines keystroke information based on the keyboard signals, and provides the keystroke information to an authentication port of the PSD.

2. The system according to claim 1, wherein the splitter routes to the keyboard only those communications that originated in the keyboard port.

3. A PSD with a computer interface comprising:

a PSD including a security controller for performing security functions, an authentication port, and a keyboard monitoring circuit having an input connected to the authentication port and an output connected to the security controller; and a splitter for receiving keyboard signals from a keyboard associated with the computer and providing the keyboard signals to a keyboard port of the computer and the authentication port of the PSD, wherein the keyboard monitoring circuit determines keystroke information based on the keyboard signals received from the authentication port, and provides the keystroke information to the security controller.

4. The system according to claim 3, wherein the PSD further includes a data port for transferring signals between the security controller and a second port of the computer.

5. The apparatus according to claim 3, wherein the splitter routes to the keyboard only those communications that originated in the keyboard port.

6. A PSD with a computer interface comprising:

a PSD including a security controller for performing security functions and an authentication port connected to an input of the security controller;

a keyboard monitoring circuit having an output connected to the authentication port; and a splitter for receiving keyboard signals from a keyboard associated with the computer and providing the keyboard signals to a keyboard port of the computer and the keyboard monitoring circuit, wherein the keyboard monitoring circuit determines keystroke information based on the keyboard signals received from the splitter, and provides the keystroke information to the authentication port of the PSD.

7. The system according to claim 6, wherein the PSD further includes a data port for transferring signals between the security controller and a second port of the computer.

8. The apparatus according to claim 6, wherein the splitter routes to the keyboard only those communications that originated in the keyboard port.

9. A PSD capable of interfacing with a computer and a computer keyboard, said PSD comprising:

A security controller for performing security functions, an authentication port;

a keyboard return port;

a keyboard monitoring circuit having an output provided to the security controller and an input; and a splitter for receiving keyboard signals from the computer keyboard via the authentication port, providing the keyboard signals to a keyboard port of the computer via the keyboard return port, and providing the keyboard signals to the input of the keyboard monitoring circuit;

wherein the keyboard monitoring circuit determines keystroke information based on the keyboard signals received from the splitter, and provides the keystroke information to the security controller.

10. The system according to claim 9, wherein the PSD further includes a data port for transferring signals between the security controller and a second port of the computer.

11. The apparatus according to claim 9, wherein the splitter routes to the keyboard only those communications that originated in the keyboard port of the computer.

* * * * *